US010330059B2

(12) United States Patent
Lohr et al.

(10) Patent No.: US 10,330,059 B2
(45) Date of Patent: Jun. 25, 2019

(54) VACUUM SYSTEM AND METHOD FOR OPERATION OF A VACUUM SYSTEM

(71) Applicant: Ford Global Technologies, LLC, Dearborn, MI (US)

(72) Inventors: John Carl Lohr, Beverly Hills, MI (US); Murray Clyde Griffin, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/601,847

(22) Filed: May 22, 2017

(65) Prior Publication Data

US 2018/0335001 A1 Nov. 22, 2018

(51) Int. Cl.
*F02M 35/10* (2006.01)

(52) U.S. Cl.
CPC ..... *F02M 35/10229* (2013.01)

(58) Field of Classification Search
CPC ..... F02M 35/10229; F02M 35/10118; F02M 35/10163; F02M 2026/0025; F02D 2009/024
See application file for complete search history.

(56) References Cited

U.S. PATENT DOCUMENTS

| | | | | |
|---|---|---|---|---|
| 6,167,699 | B1 | 1/2001 | Johnston et al. | |
| 2006/0016477 | A1 | 1/2006 | Zaparackas | |
| 2011/0132311 | A1 | 6/2011 | Pursifull et al. | |
| 2013/0152904 | A1* | 6/2013 | Balsdon | F02M 25/0836 123/518 |
| 2015/0114321 | A1* | 4/2015 | Stockbridge | B60T 13/46 123/2 |
| 2015/0147196 | A1* | 5/2015 | Chahal | B60T 8/4077 417/151 |
| 2016/0040688 | A1* | 2/2016 | Fletcher | F02B 37/04 123/184.53 |
| 2016/0061164 | A1* | 3/2016 | Fletcher | F02M 25/0706 123/568.11 |

* cited by examiner

*Primary Examiner* — Long T Tran
(74) *Attorney, Agent, or Firm* — Julia Voutyras; McCoy Russell LLP

(57) ABSTRACT

A vacuum system is provided. The vacuum system includes a vacuum aspirator coupled to a housing of an intake manifold, the vacuum aspirator including an air intake port, a vacuum port, and a manifold port. The vacuum system also includes a manifold vacuum passage and a vacuum reservoir passage traversing the housing of the intake manifold, the manifold vacuum passage coupled to the manifold port and the vacuum reservoir passage coupled to the vacuum port.

20 Claims, 7 Drawing Sheets

VACUUM SYSTEM AND METHOD FOR OPERATION OF A VACUUM SYSTEM

BACKGROUND/SUMMARY

Vehicles have utilized vacuum generated in the intake system to assist in operation of various engine systems such as braking systems, cruise control systems, exhaust gas recirculation (EGR) systems, etc. For instance, vacuum may be used for brake boost to amplify the driver's brake pedal input, enabling a reduction in the driver's braking effort. However, fuel efficiency standards, turbochargers, etc., have led to the downsizing of some vehicle engines, resulting in a reduced ability to provide vacuum to auxiliary vehicle systems from the intake manifold. To cope with the drop in vacuum levels, aspirators have been used in engines to charge vacuum reservoirs that provide a vacuum reserve from which auxiliary vehicle systems can draw from.

Previous aspirator designs have routed airflow to and from the aspirator via external hoses. The inventors have recognized several drawbacks with this type of aspirator design and other prior aspirator designs. The external routing of aspirator hoses increases the bulkiness of the vacuum system. As such, the engine may not be able to meet packaging constraints in some vehicles, such as vehicles where space is at a premium. Furthermore, the external hoses may be susceptible to damage during engine manufacturing and maintenance. Damage to the hoses can cause leaks that can diminish the aspirator's ability to generate a vacuum or render the aspirator inoperable, in some cases. The externally routed hoses may also experience significant flow losses due to the length and contours of the hoses, thereby reducing the system's efficiency.

The inventors have recognized the aforementioned drawbacks and facing these challenges developed a vacuum system. The vacuum system includes, in one example, a vacuum aspirator coupled to a housing of an intake manifold, the vacuum aspirator including an air intake port, a vacuum port, and a manifold port. The vacuum system also includes a manifold vacuum passage and a vacuum reservoir passage traversing the housing of the intake manifold, the manifold vacuum passage coupled to the manifold port and the vacuum reservoir passage coupled to the vacuum port. Routing the vacuum reservoir passage and the manifold vacuum passage through the intake manifold housing enables the system to achieve space saving gains through a reduction in the profile of the vacuum system. Additionally, internal routing of the vacuum reservoir passage and the manifold vacuum passage facilitates an increase in the durability of the vacuum system and a reduction in the likelihood of component damage during manufacturing, repair, and maintenance, when compared to previous engine systems. Flow losses in the vacuum system may also be diminished through a reduction in the length manifold vacuum conduit when compared to systems with externally routed hoses providing fluidic connection between the intake manifold and an aspirator.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-6 are drawn to scale. However, other relative dimensions may be used.

DETAILED SPECIFICATION

Figure 1:
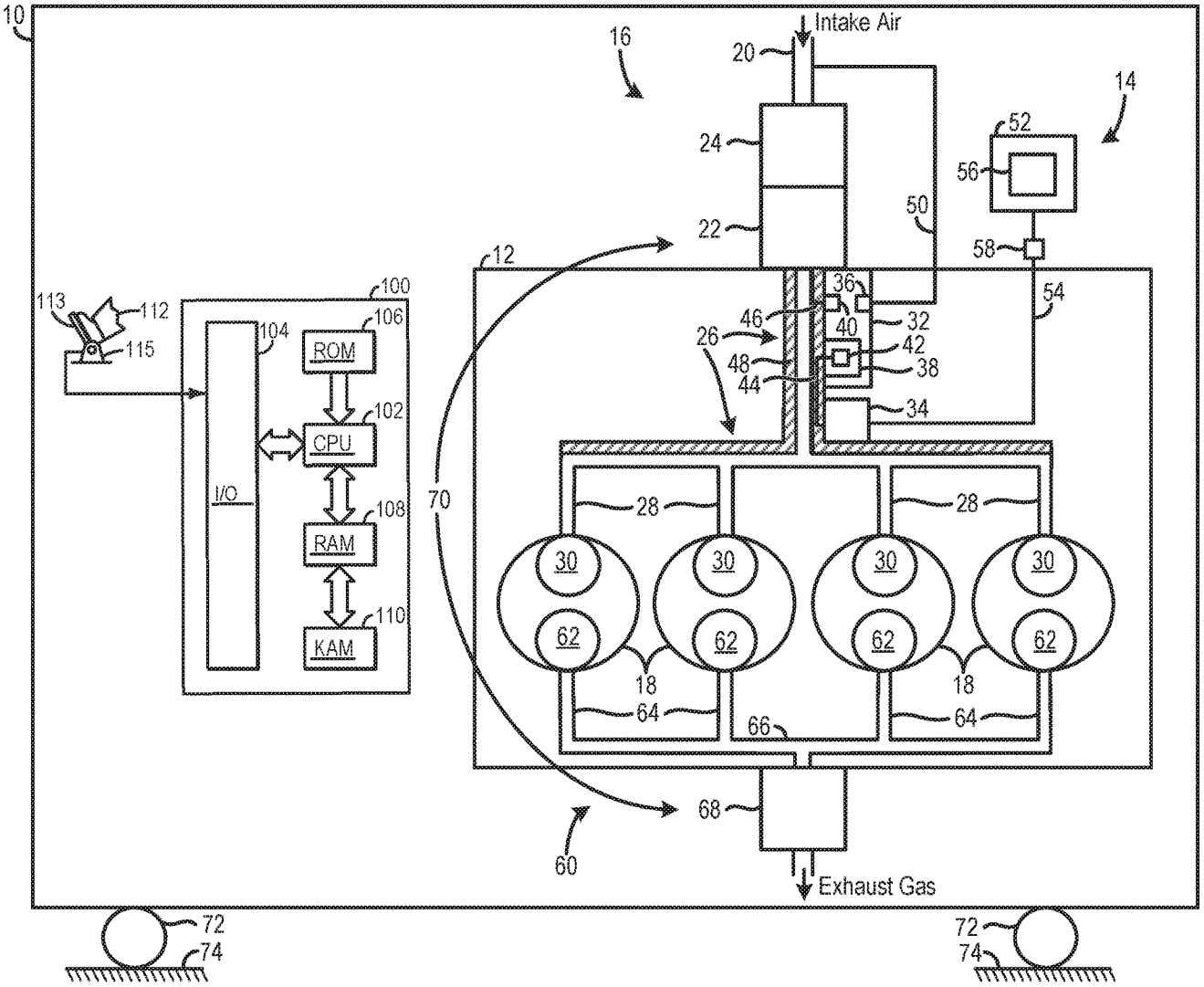
FIG. 1 is a schematic depiction of a vehicle including an engine and vacuum system.
Figure 2:
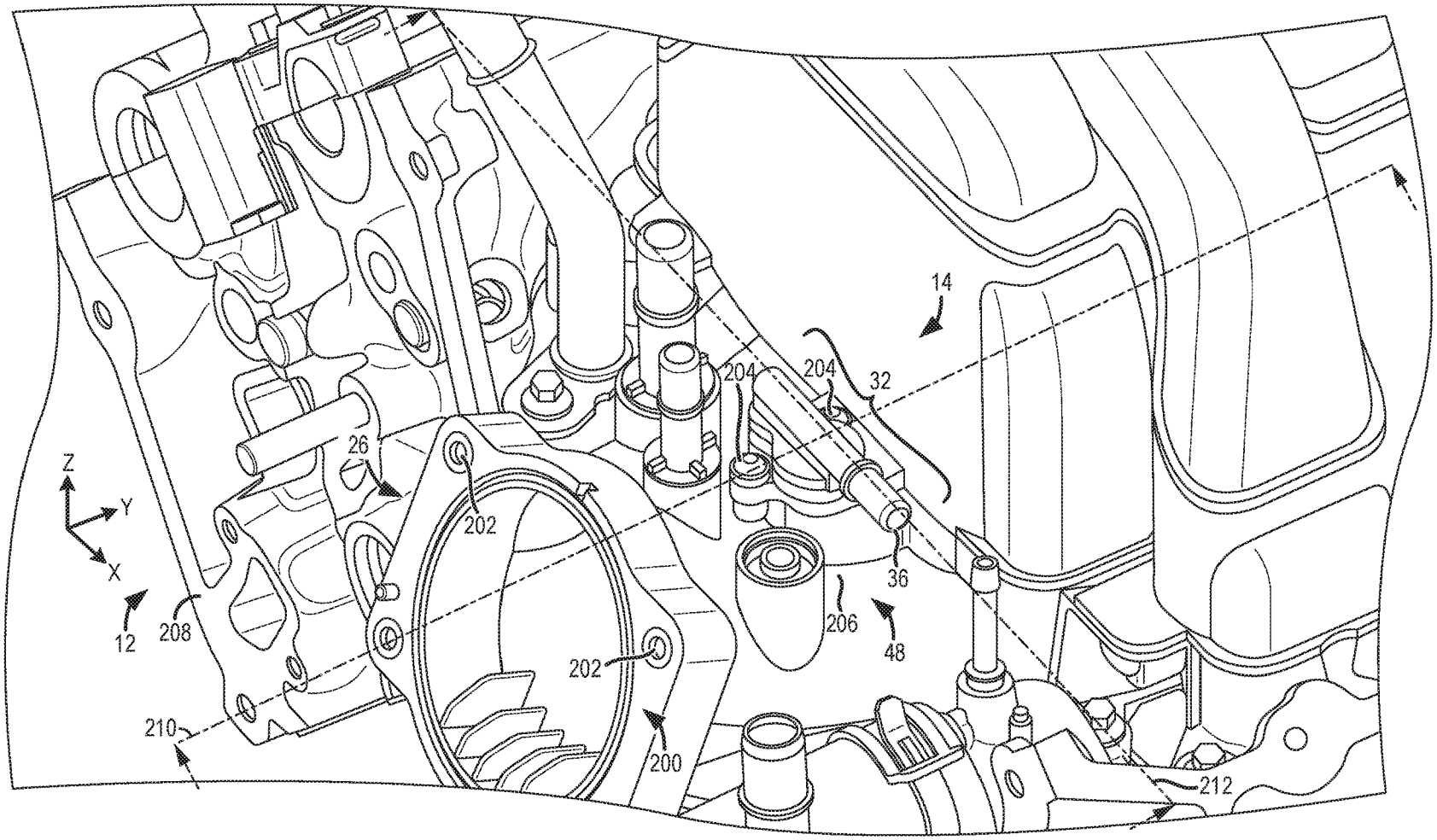
FIG. 2 is a depiction of an exemplary engine and vacuum system.
Figure 3:
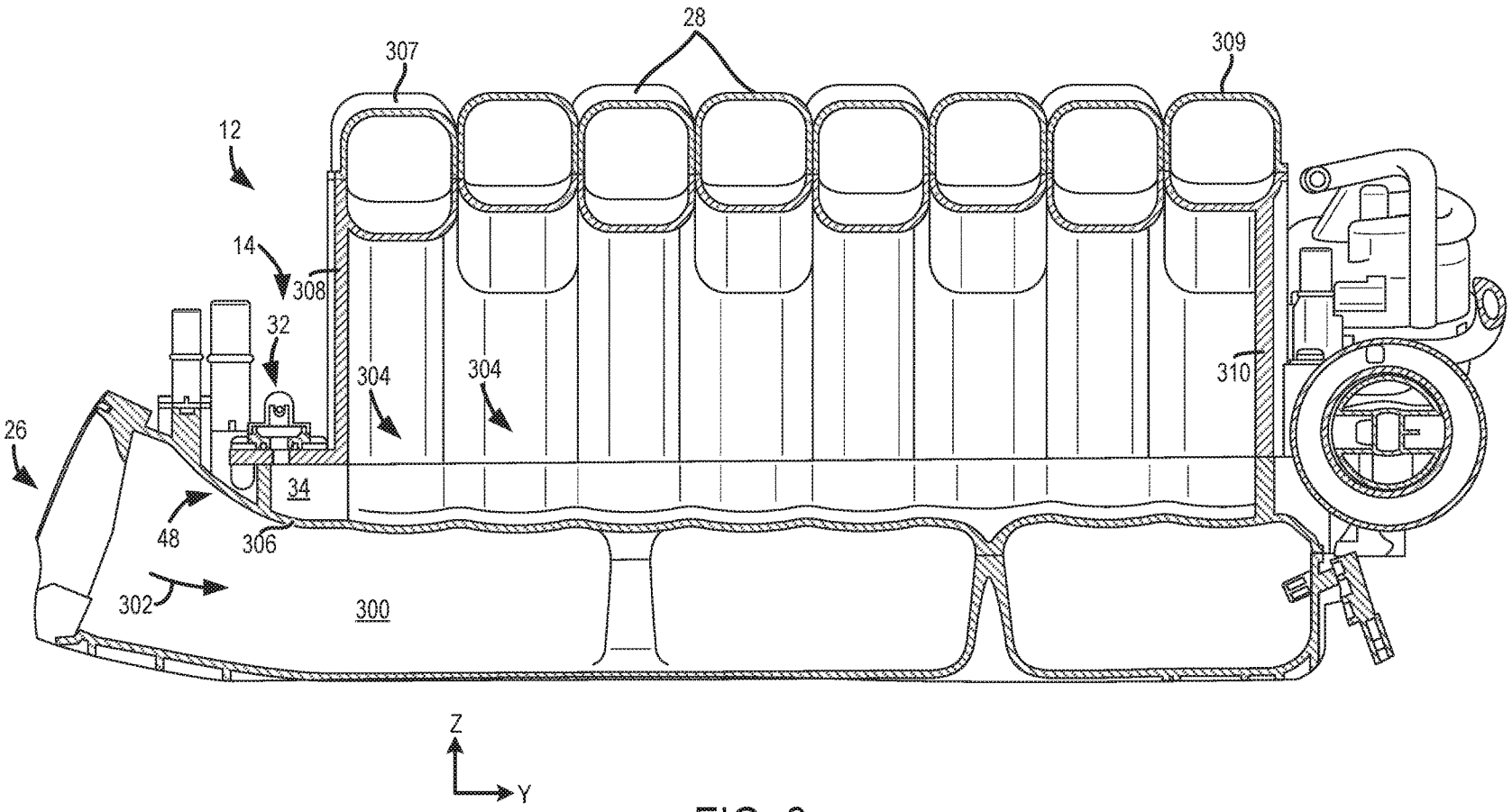
FIGS. 3, 4, and 5 show cross-sectional views of the engine and vacuum system shown in FIG. 2.
Figure 4:
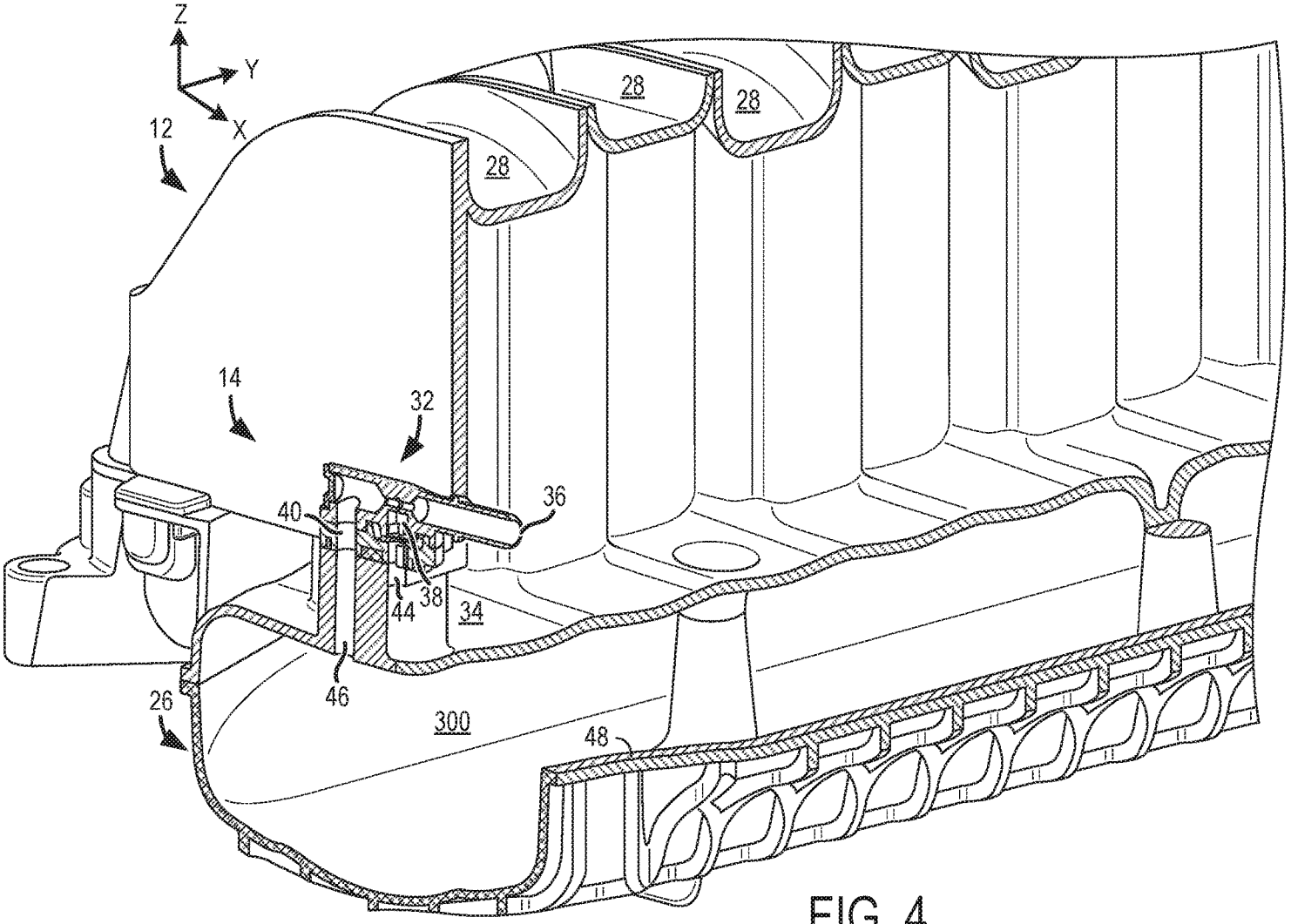
Figure 5:
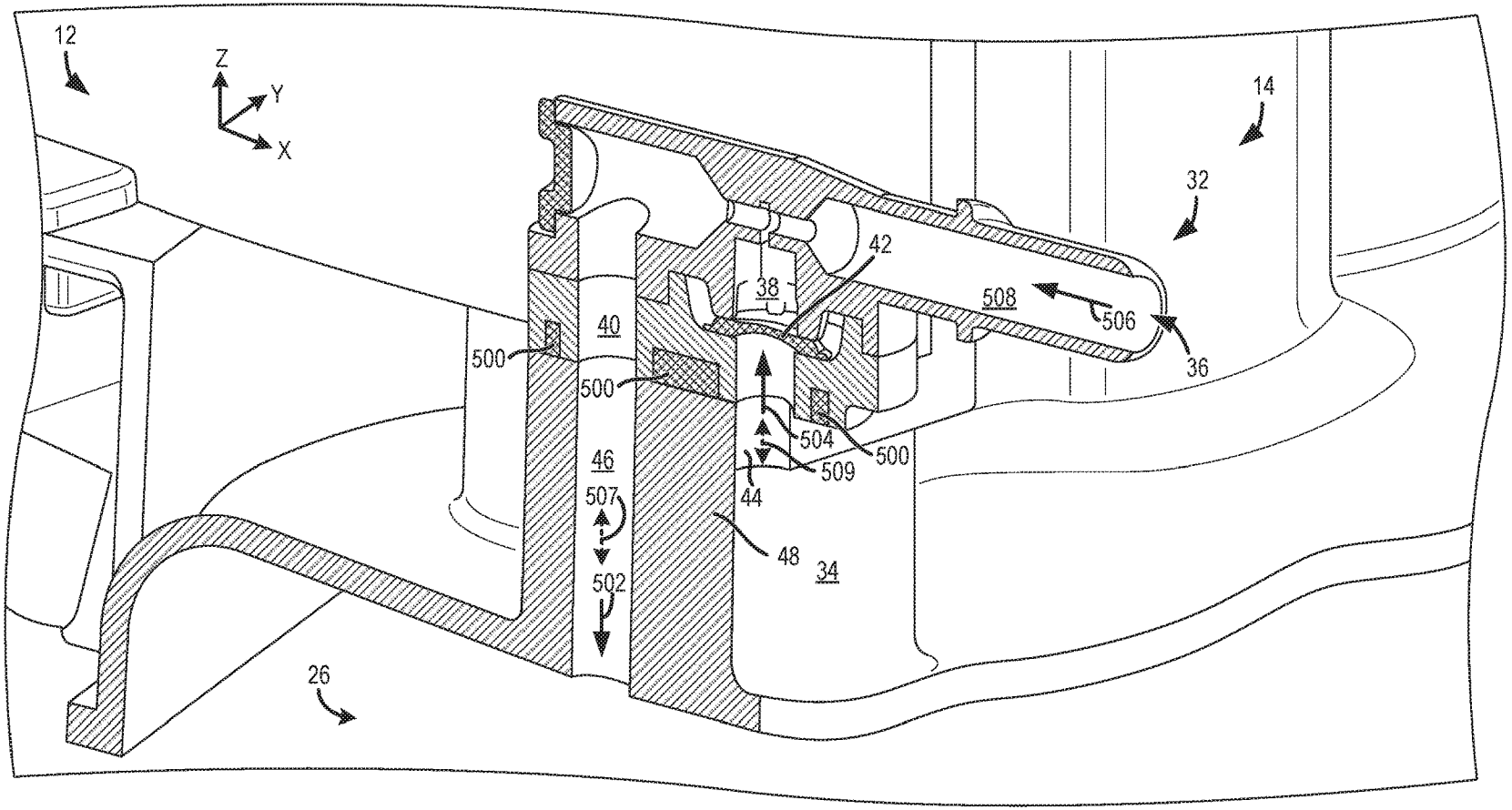
Figure 6:
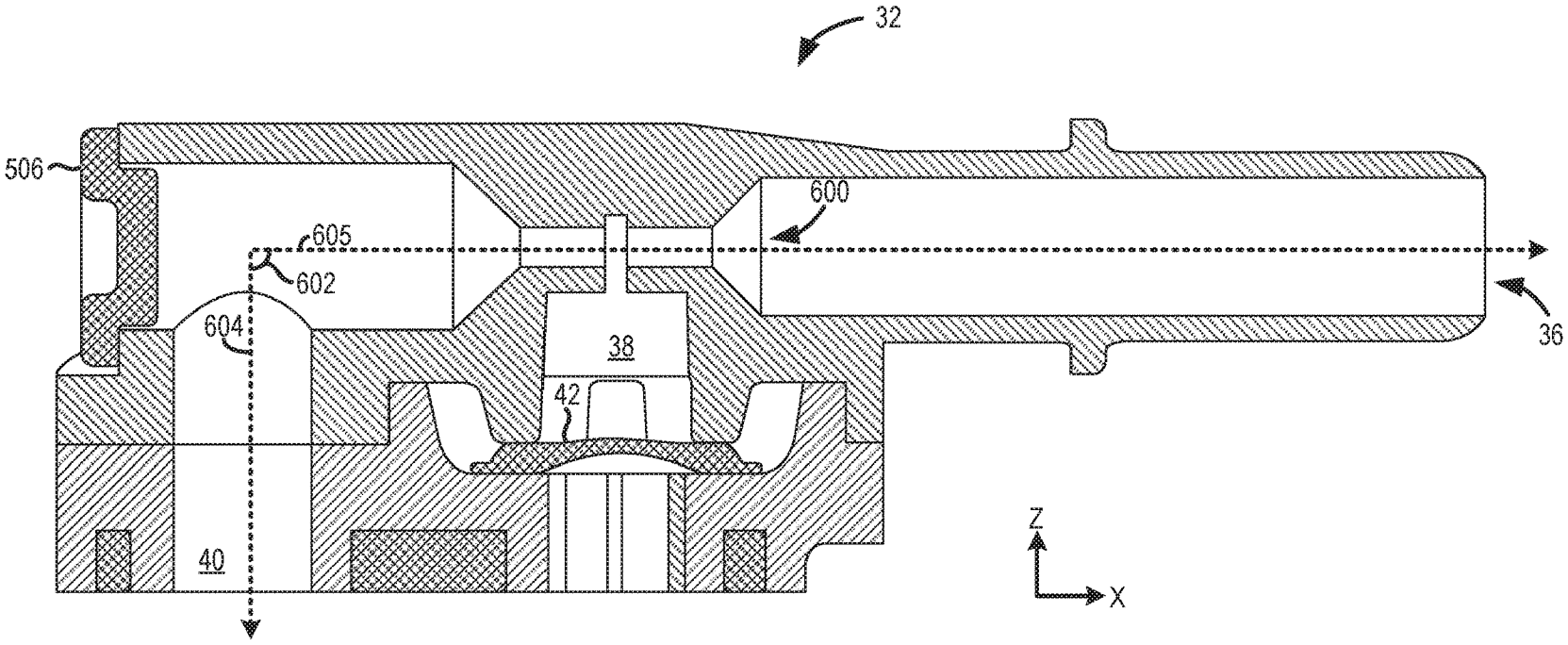
FIG. 6 shows a detailed cross-sectional view of the vacuum aspirator shown in FIG. 2.
Figure 7:
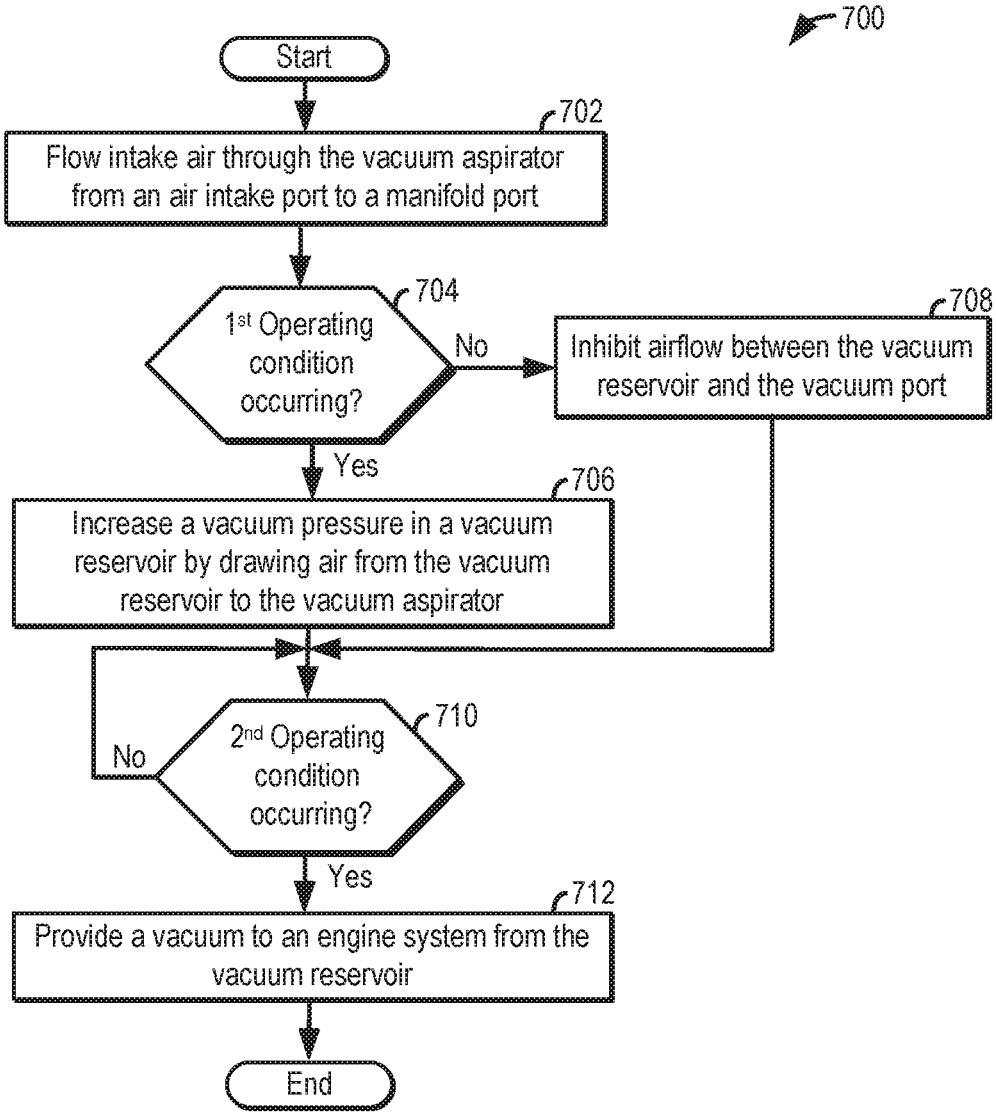
FIG. 7 shows a method for operation of a vacuum system.

A compact, durable, and efficient vacuum system and method for operation thereof is described herein. In an example, the vacuum system may include a manifold vacuum passage fluidically connecting a vacuum aspirator to an intake manifold and a vacuum reservoir passage fluidically connecting the vacuum aspirator to a vacuum reservoir. The vacuum aspirator is configured to charge the vacuum reservoir using the dynamics of the intake air routed through the aspirator. The vacuum aspirator may be mounted to a housing of an intake manifold and both the manifold vacuum passage and the vacuum reservoir passage may be internally routed through the intake manifold housing. Furthermore, the vacuum aspirator may include a vacuum port and a manifold port, each port is coupled to their respective passage. Providing internal routing of the manifold vacuum passage and the vacuum reservoir passage through the intake manifold housing enables the compactness of the system to be increased. Additional benefits realized by the internal routing of the vacuum reservoir passage and manifold vacuum passage include increased durability stemming from the protected nature of the internally routed passages, when compared to system's using external hoses. Furthermore, flow losses through the vacuum system may be reduced when internal routing of the manifold vacuum passages is used, due to the decrease in the length of the passage when compared to systems using an external manifold hose. In an additional example, the vacuum reservoir may be positioned in a location between the intake runners and the intake manifold, to achieve further space saving benefits. FIG. 1 shows a schematic depiction of a vehicle including a vacuum system. FIG. 2 shows an exemplary engine and vacuum system. FIGS. 3-5 show different cross-sectional views of the engine and vacuum system, shown in FIG. 2. FIG. 6 shows a detailed cross-sectional view of the vacuum aspirator in the vacuum system, shown in FIG. 2. FIG. 7 shows a method for operation of a vacuum system.

FIG. 1 shows a schematic depiction of a vehicle 10 including an engine 12 and a vacuum system 14. Although, FIG. 1 provides a schematic depiction of various engine and vacuum system components, it will be appreciated that the some of the components, such as the vacuum system components, have a different spatial positions and greater structural complexity than the components shown in FIG. 1. The structural details of the components are discussed in greater detail herein with regard to FIGS. 2-6.

The vehicle 10 includes an intake system 16 providing intake air to cylinders 18. The intake system 16 includes an intake conduit 20 and a throttle 22. Although, FIG. 1 depicts the engine 12 with four cylinders. The engine 12 may have an alternate number of cylinders, in other examples. For instance, the engine 12 may include a single cylinder, two cylinders, six cylinders, etc., in other examples. The intake system 16 also includes a compressor 24 configured to provide boost to cylinders 18, to increase the engine's efficiency and/or power output.

The intake system 16 further includes an intake manifold 26 positioned downstream of the throttle 22. The intake manifold 26 feeds intake air to intake runners 28. In turn, each of the intake runners 28 are coupled to one of the intake valves 30 coupled to one of the respective cylinders 18. Thus, the intake runners 28 are in fluidic communication with the intake manifold 26.

During engine operation, each cylinder typically undergoes a four stroke cycle including an intake stroke, compression stroke, expansion stroke, and exhaust stroke. During the intake stroke, generally, the exhaust valves close and intake valves open. Air is introduced into the cylinder via the corresponding intake passage, and the cylinder piston moves to the bottom of the cylinder so as to increase the volume within the cylinder. The position at which the piston is near the bottom of the cylinder and at the end of its stroke (e.g., when the combustion chamber is at its largest volume) is typically referred to by those of skill in the art as bottom dead center (BDC). During the compression stroke, the intake valves and exhaust valves are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber through direct and/or port injectors. In a process herein referred to as ignition, the injected fuel is ignited by known ignition means, such as a spark plug or compression, resulting in combustion. During the expansion stroke, the expanding gases push the piston back to BDC. A crankshaft converts this piston movement into a rotational torque of the rotary shaft. During the exhaust stroke, in a traditional design, exhaust valves are opened to release the residual combusted air-fuel mixture to the corresponding exhaust passages and the piston returns to TDC.

The vacuum system 14 includes a vacuum aspirator 32 configured to generate vacuum from intake air routed therethrough. The vacuum aspirator 32 may be an ejector, injector, educator, venturi pump, jet pump, or other suitable passive device. The vacuum generated by the vacuum aspirator 32 may be directed to and stored in a vacuum reservoir 34.

The vacuum aspirator 32 is shown coupled to the intake manifold 26. Additionally, the vacuum aspirator 32 include ports for routing air to and away from the aspirator. The ports include an air intake port 36, a vacuum port 38, and a manifold port 40. A check valve 42 may be positioned in the vacuum port 38. The check valve 42 may be configured to permit and inhibit airflow through the vacuum port based on the vacuum pressure in the vacuum port and the vacuum pressure in the vacuum reservoir 34. The vacuum system 14 further includes a vacuum reservoir passage 44 that is coupled to the vacuum port 38 and the vacuum reservoir 34 as well as a manifold vacuum passage 46 coupled to the manifold port 40 and the intake manifold 26. In the vacuum aspirator 32 air travels from the air intake port 36 to the manifold port 40 to generate a vacuum in the vacuum port 38. It will be appreciated that the internal profile of the vacuum aspirator enables generation of the vacuum using the internal airflow. Moreover, it will be appreciated that the vacuum reservoir 34 may be in fluidic communication with the vacuum reservoir passage 44 when the check valve 42 is open.

Both the vacuum reservoir passage 44 and the manifold vacuum passage 46 are routed internally through a housing 48 of the intake manifold 26, enabling the compactness of the vacuum system 14 to be increased. The specific regarding the routing of the passages and the details of the attachment between the vacuum aspirator 32 and the intake manifold 26 are discussed in greater detail herein with regard to FIGS. 2-6.

The vacuum system 14 also include an air inlet conduit 50 coupled to the air intake port 36 and the intake conduit 20, providing airflow to the vacuum aspirator 32. The air inlet conduit 50 may be externally routed with regard to the housing 48 of the intake manifold 26, in one example.

The vacuum reservoir 34 may provide a vacuum to an engine system 52 through vacuum conduit 54. The engine system 52 may be a braking system with a brake booster 56. However, the engine system 52 may be a cruise control system or an exhaust gas recirculation (EGR) system, in other examples. Still further in other examples, the vacuum reservoir 34 may supply a vacuum to multiple engine systems. In such an example, additional valves in the vacuum system may regulate the vacuum provided to the multiple engine systems.

Valve 58 coupled to the vacuum conduit 54 may regulate the fluidic connection between the vacuum reservoir 34 and the engine system 52. For instance, when valve 58 is opened the engine system 52 may be able to utilize the vacuum in the vacuum reservoir 34 and when the valve 58 is closed the engine system 52 may be prevented from using the vacuum in the vacuum reservoir.

An exhaust system 60 is also included in the vehicle 10. The exhaust system 60 may include exhaust valves 62 coupled to the cylinders 18, exhaust runners 64, an exhaust manifold 66, and a turbine 68. Additional components that may be included in the exhaust system may include an emission control device (not shown), a silencer (not shown), etc.

The compressor 24 and turbine 68 may be connected via a drive shaft (not shown) in a turbocharger 70. However, in other examples the compressor 24 may be a supercharger driven by the rotational output of the engine. Further, in other examples the turbocharger may be omitted from the engine.

The vehicle 10 may also include wheels 72 that may propel the vehicle along a driving surface 74. In the depicted example, the driving surface 74 is perpendicular to a vertical axis. However in other example, the driving surface 74 may have alternate orientations.

FIG. 1 also shows a controller 100 in the vehicle 10. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 12 and other vehicle systems. The sensors may include engine coolant temperature sensor (not shown), exhaust gas sensors (not shown), an intake airflow sensor (not shown), etc. Additionally, the controller 100 is also configured to receive throttle position (TP) from a throttle position sensor 115 coupled to a pedal 113 actuated by an operator 112.

Additionally, the controller 100 may be configured to trigger one or more actuators and/or send commands to components. For instance, the controller 100 may trigger adjustment of the throttle 22, the valve 58, and/or turbocharger 70. Therefore, the controller 100 receives signals from the various sensors and employs the various actuators to adjust engine operation based on the received signals and instructions stored in memory of the controller. Thus, it will be appreciated that the controller 100 may send and receive signals from the engine system 52.

FIG. 2 shows an illustration of an example engine 12 and vacuum system 14. The engine 12 includes the intake manifold 26 having an attachment interface 200 with openings 202. The attachment interface 200 may be coupled to an upstream component such as the throttle 22, shown in FIG. 1. Continuing with FIG. 2, the vacuum aspirator 32 is attached (e.g., directly attached) to the housing 48 of the intake manifold 26. Attachment devices 204 (e.g., bolts) may enable the attachment between vacuum aspirator 32 and the housing 48. However, additional or alternative attachment mechanisms have been contemplated.

In the depicted example, the vacuum aspirator 32 is attached to the intake manifold 26 at a location downstream of the attachment interface 200. Additionally, the vacuum aspirator 32 is coupled to an upper surface 206 of the housing 48. When the vacuum aspirator 32 and intake manifold 26 are arranged in this way internal routing of passages flowing air to and from the vacuum aspirator through the intake manifold housing may be achieved without interfering with other nearby components. As a result, the system's compactness can be increased when compared to systems that use externally routed hoses without negatively impacting operation of surrounding components. However, other attachment positions of the vacuum aspirator 32 have been contemplated. For instance, the vacuum aspirator 32 may be coupled to a lateral side or an underside of the housing 48.

The air intake port 36 of the vacuum aspirator 32 is also shown in FIG. 2. As previously discussed the air inlet conduit 50, shown in FIG. 1, may be coupled to the air intake port 36 and the intake conduit 20, shown in FIG. 1. Additionally, a section of a cylinder head 208 of the engine 12 is also shown in FIG. 2. It will be appreciated that the cylinder head 208 may be coupled to a cylinder block (not shown) to form the cylinders 18, shown in FIG. 1.

In FIG. 2 coordinate axes (X, Y, and Z) are provided for reference. In one example, the Z axis may be parallel to the gravitational axis. However, in other examples the engine 12 may have other orientations. Further, the X axis may be a lateral or horizontal axis and the Y axis may be longitudinal axis. Also, viewing plane 210 indicates the viewing perspective of the cross-sectional view shown in FIG. 3 and viewing plane 212 indicates the viewing perspective of the cross-sectional view shown in FIGS. 4 and 5.

FIG. 3 shows a cross-sectional view of the engine 12 and vacuum system 14. Again, the coordinate axes (Z and Y) are provided for reference. The vacuum aspirator 32 and the housing 48 of the intake manifold 26 are shown in FIG. 3. At least a portion of the housing 48 may define a boundary of an interior section 300 of the intake manifold 26 through which intake air travels. Arrow 302 indicates the general direction of downstream flow of intake air through the interior section 300 of the intake manifold 26.

The intake runners 28 receiving airflow from the intake manifold 26 are also shown in FIG. 3. The intake runners 28 extend in a vertical direction and then arc back towards their respective cylinder valve, in the depicted example. However, the intake runners 28 may have other contours, in other examples. For instance, the intake runners may laterally extend from the intake manifold. Additionally, each of the intake runners 28 may provide intake air to a different intake valve. The engine 12 shown in FIG. 2 may include two intake valves per cylinder. However other intake valve configurations may be used, in other instances.

The vacuum reservoir 34 is also shown in FIG. 3. As previously discussed the vacuum reservoir 34 is charged by the vacuum aspirator 32 during certain engine operating conditions. The vacuum reservoir 34 is shown positioned between the intake manifold 26 and the intake runners 28. Specifically, the vacuum reservoir 34 is position above (e.g., vertically above) the intake manifold 26 and adjacent to sections 304 of the intake runners 28. Thus, the vacuum reservoir 34 may be position between (e.g., laterally between) vertical sections of the arcing intake runners 28. Furthermore, the vacuum reservoir 34 is shown extending longitudinally from a first peripheral runner 307 (e.g., runner of a first cylinder when sequentially numbering cylinders in a longitudinal direction) to a second peripheral runner 309 (e.g., runner of a fourth cylinder when sequentially numbering cylinders in a longitudinal direction), each of the first and second peripheral runners included in the plurality of intake runners 28. Therefore in one example, a portion of a boundary of the vacuum reservoir 34 may be defined by a first intake runner wall 308 (e.g., front wall) and a second intake runner wall 310 (e.g., rear wall). Positioning the vacuum reservoir 34 in this interior engine location enables the compactness of the vacuum system 14 to be increased, when compared to an externally positioned reservoir. Consequently, the engine can achieve space saving gains when the vacuum reservoir is positioned between the intake runners 28 in the manner discussed above. However, other positions of the vacuum reservoir have been contemplated such as in a location longitudinally between sequential intake runners, beneath a plenum of the intake manifold, attached (e.g., welded) to a section of the intake manifold, etc.

Additionally, the vacuum reservoir 34 and the intake manifold 26 share a common boundary wall 306, in the illustrated example. In this way, the compactness of the vacuum system 14 can be further increased. Specifically, the boundary wall 306 is depicted as extending in lateral and longitudinal directions. However in other examples, each of the intake manifold 26 and the vacuum reservoir 34 may have a separate boundary wall that may have different contours.

FIG. 4 shows a cross-sectional view of the engine 12 and vacuum system 14. Coordinate axes (X, Y, and Z) are again provided for reference. FIG. 4 depicts a portion of the housing 48 of the intake manifold 26 cut away to illustrate the contours of the interior section 300. The vacuum aspirator 32 is depicted with the air intake port 36, vacuum port 38, and manifold port 40, in FIG. 4. Intake air is fed to the vacuum reservoir via the air intake port 36 and then expelled to the intake manifold 26 through the manifold port 40 and the manifold vacuum passage 46. Thus, the manifold vacuum passage 46 provides fluidic communication between the manifold port 40 and the intake manifold 26 and specifically the interior section 300 of the intake manifold 26. Airflow through the vacuum aspirator 32 from the air intake port 36 to the manifold port 40 generates a vacuum in the vacuum port 38, enabling the vacuum reservoir 34 to be charged during certain operating conditions via airflow through the vacuum reservoir passage 44 and the vacuum port 38. FIG. 5 shows a more detailed view of the cross-section of the engine 12 and in particular the vacuum system 14 depicted in FIG. 4. Coordinate axes (X, Y, and Z) are again provided for reference in FIG. 5. The vacuum aspirator 32 is depicted with the air intake port 36, vacuum port 38, and manifold port 40. The vacuum reservoir passage 44 is shown attached to the vacuum port 38 and extending through the housing 48 of the intake manifold 26. Likewise, the manifold vacuum passage 46 is shown attached to the manifold port 40 and extending through the housing 48 of the intake manifold 26. As shown, the manifold vacuum passage 46 opens into the intake manifold 26 and the vacuum reservoir passage 44 opens into the vacuum reservoir 34. Arrow 502 depicts the general flow direction of air through the manifold vacuum passage 46 while combustion is occurring in the engine 12. Arrow 504 depicts the general flow direction of air through the vacuum reservoir passage 44 when the check valve 42 is open. Additionally, arrow 506 depicts the general direction of airflow through the valve section 508 downstream of the air intake port 36 while combustion is occurring in the engine 12. However, it will be appreciated that the airflow pattern in the vacuum aspirator 32 may have greater complexity.

Furthermore, both the vacuum reservoir passage 44 and the manifold vacuum passage 46 vertically extend through the housing 48 of the intake manifold 26 and are parallel to one another, in the illustrated example. Additionally, the central axis 507 of the manifold vacuum passage 46 and the central axis 509 of the vacuum reservoir passage 44 are substantially straight, in the depicted example. Routing the vacuum reservoir passage 44 and the manifold vacuum passage 46 in this way may enable the passages to avoid interference with other engine component while achieving space saving gains and reducing flow losses. However, other contours of the vacuum reservoir passage 44 and the manifold vacuum passage 46 that also achieve space saving benefits may be used, in other examples. For example, the vacuum reservoir passage 44 and the manifold vacuum passage 46 may vertically extend through the housing in directions that are non-parallel with regard to one another or may vertically extend through the housing in a first section and then laterally or longitudinally extend through the housing in another section. In another example, the vacuum reservoir passage 44 and the manifold vacuum passage 46 may have curved sections.

The vacuum aspirator 32 also includes a gasket 500 configured to provide a robust seal between the housing 48 and the vacuum aspirator 32. Specifically, the gasket 500 may extend around the interface between the vacuum port 38 and the vacuum reservoir passage 44 as well as the interface between the manifold port 40 and the manifold vacuum passage 46.

The vacuum aspirator 32 further includes the check valve 42. The check valve 42 is configured to open and close and allow and inhibit airflow between the vacuum reservoir 34 and the vacuum port 38. Specifically, the check valve 42 may be configured to open when the vacuum pressure generated in the vacuum port 38 of the vacuum aspirator 32 is greater than the vacuum pressure in the vacuum reservoir 34. Likewise, the check valve 42 may also be configured to close when the vacuum pressure generated in the vacuum port 38 of the vacuum aspirator 32 is less than the vacuum pressure in the vacuum reservoir 34. In this way, depletion of the vacuum reservoir can be avoided when the vacuum aspirator is not generating enough of a vacuum to further charge the reservoir.

FIG. 6 shows a detailed view a cross-section of the vacuum aspirator 32 in the vacuum system 14, depicted in FIG. 2. The coordinate axes (Z and X) are again provided for reference. The air intake port 36, vacuum port 38, and the manifold port 40 of the vacuum aspirator 32 are illustrated in FIG. 6. The vacuum aspirator 32 includes a tube 600 that narrows and then expands in cross-sectional area to generate a vacuum in the vacuum port 38 while air is flowing through the aspirator from the air intake port 36 to the manifold port 40.

An angle 602 formed between a central axis 604 of the manifold port 40 and a central axis 605 of the air intake port 36 is shown in FIG. 6. The angle 602 may be non-straight and specifically in the depicted example is 90 degrees. Arranging the ports at this angle enables the efficient routing of air to the intake manifold 26, shown in FIGS. 2-5, from the vacuum aspirator 32. However, other angles have been contemplated.

The check valve 42 is also depicted in FIG. 6. The vacuum aspirator 32 also includes a plug 606, in the illustrated example. However, other vacuum aspirator configurations where a housing of the aspirator extends across the region blocked by the plug 606 may be used, in other examples.

FIG. 7 shows a method 700 for operation of a vacuum system. The method 700 may be implemented by the vacuum system and corresponding components discussed above with regard to FIGS. 1-6 or in other examples may be implemented by other suitable vacuum systems.

At 702 the method includes flowing intake air through the vacuum aspirator from an air intake port to a manifold port. The intake air may be routed to the air intake port through an air inlet conduit extending between an intake conduit upstream of a throttle and an air intake port. Additionally, air may be routed from the manifold port to a manifold vacuum passage coupled to the manifold port and then to an intake manifold. The manifold vacuum passage may traverse a housing of the intake manifold, enabling a reduction in the profile of the vacuum system. It will be appreciated that step 702 may occur while the engine is performing combustion and generating vacuum in the intake manifold. As such in one example, intake air may be continuously flowed from the air intake port to the manifold port during combustion operation.

At 704 the method includes determining if a first operating condition is occurring. The first operating condition may include a condition where a vacuum pressure in a vacuum reservoir charged by the vacuum aspirator is less than a vacuum pressure in the intake manifold. In this way, depleting the vacuum in the vacuum reservoir when the vacuum in the intake manifold is less than the reservoir may be avoided. However, it will be appreciated that the first operating condition may include additional or alternative operating conditions. For instance, the first operating condition may include a condition where boost generated by a compressor upstream of the intake manifold is less than a predetermined threshold and/or a condition when engine speed is less than a threshold value.

If it is determined that the first operating condition is occurring (YES at 704) the method proceeds to 706. At 706 the method includes increasing a vacuum pressure in a vacuum reservoir by drawing air from the vacuum reservoir to the vacuum aspirator. As described herein an increase in a vacuum pressure indicates an increase towards a theoretical perfect vacuum. Air may travel from the vacuum reservoir through a vacuum reservoir passage coupled to the vacuum port. Additionally, the vacuum reservoir passage may extend through the housing of the intake manifold, providing further space saving benefits.

If it is determined that the first operating condition is not occurring (NO at 704) the method advances to 708. At 708 the method includes inhibiting airflow between the vacuum reservoir and the vacuum port. In one example, a check valve positioned in the vacuum port may be used to inhibit airflow between the reservoir and the vacuum port.

At 710 the method includes determining if a second operating condition is occurring. The second operating condition may be a condition when an engine system requests or needs a vacuum connection. Specifically in one example, the second operating condition may include a condition when a brake pedal in a braking system with a brake booster is actuated by a driver.

If it is determined that the second operating condition is not occurring (NO at 710) the method returns to 710. On the other hand, if it is determined that the second operating condition is occurring (YES at 710) the method advances to 712. At 712 the method includes providing a vacuum to an engine system from the vacuum reservoir. The engine system may be a braking system, in one example. However in other examples the engine system may be a cruise control system, an EGR system, etc. Further in one example, when it is determined that second operating condition is occurring charging of the vacuum reservoir by the vacuum aspirator may be stopped. However in other examples, the vacuum reservoir may be replenished while the engine system is drawing a vacuum from the vacuum reservoir. Method 700 enables a compact vacuum system to efficiently charge the vacuum reservoir during selected time periods. As a result, vacuum generated in the intake system can be efficiently managed through the storage of the vacuum and subsequent provision of the vacuum to selected engine systems. In this way, vacuum needs of engine systems can be met even when the intake system may not be generating a desired vacuum pressure.

The subject matter of the present disclosure is further described in the following paragraphs. According to one aspect, a vacuum aspirator system is provided. The vacuum aspirator system includes a vacuum aspirator coupled to a housing of an intake manifold, the vacuum aspirator including an air intake port, a vacuum port, and a manifold port and a manifold vacuum passage and a vacuum reservoir passage traversing the housing of the intake manifold, the manifold vacuum passage coupled to the manifold port and the vacuum reservoir passage coupled to the vacuum port.

According to another aspect, a vacuum aspirator system is provided. The vacuum aspirator system includes a vacuum aspirator coupled to a housing of an intake manifold, the vacuum aspirator including an air intake port, a vacuum port, and a manifold port, a manifold vacuum passage and a vacuum reservoir passage traversing the housing of the intake manifold, the manifold vacuum passage extending between the manifold port and an interior chamber the intake manifold and the vacuum reservoir passage extending between the vacuum port and the vacuum reservoir, and a vacuum reservoir in fluidic communication with the vacuum reservoir passage.

According to another aspect, a method for operating a vacuum aspirator system is provided. The method includes during a first operating condition, increasing a vacuum pressure in a vacuum reservoir by drawing air from the vacuum reservoir to a vacuum aspirator through a vacuum conduit extending through a housing of an intake manifold, the vacuum conduit coupled to a vacuum port in the vacuum reservoir and during a second operating condition, providing a vacuum to an engine system from the vacuum reservoir.

In any of the aspects described herein or combinations of the aspects, the vacuum aspirator system may further include a check valve positioned in the vacuum port.

In any of the aspects described herein or combinations of the aspects, the check valve may open when a vacuum pressure in the vacuum port is greater than a vacuum pressure in a vacuum reservoir, the vacuum reservoir in fluidic communication with the vacuum reservoir passage.

In any of the aspects described herein or combinations of the aspects, the air intake port may be coupled to an air inlet conduit upstream of a throttle via an external conduit.

In any of the aspects described herein or combinations of the aspects, the vacuum aspirator system may further include a vacuum reservoir in fluidic communication with the vacuum reservoir passage.

In any of the aspects described herein or combinations of the aspects, the vacuum reservoir may be positioned between an intake runner and the intake manifold and the intake runner may be fluidic communication with the intake manifold.

In any of the aspects described herein or combinations of the aspects, the vacuum reservoir may be positioned vertically above the intake manifold and adjacent to a section the intake runner.

In any of the aspects described herein or combinations of the aspects, the vacuum reservoir passage and the manifold vacuum passage may vertically extend through the housing of the intake manifold.

In any of the aspects described herein or combinations of the aspects, the intake manifold and the vacuum reservoir may share a common boundary wall.

In any of the aspects described herein or combinations of the aspects, the vacuum aspirator system may further include a compressor upstream of the intake manifold.

In any of the aspects described herein or combinations of the aspects, the vacuum reservoir may be positioned between an intake runner and the intake manifold, the intake runner in fluidic communication with the intake manifold.

In any of the aspects described herein or combinations of the aspects, the vacuum reservoir may be positioned adjacent to an intake runner and vertically above the intake manifold.

In any of the aspects described herein or combinations of the aspects, the vacuum reservoir may be positioned laterally between different sections of an intake runner.

In any of the aspects described herein or combinations of the aspects, the vacuum reservoir passage and the manifold vacuum passage may vertically extend through the housing of the intake manifold.

In any of the aspects described herein or combinations of the aspects, the method may further include inhibiting airflow between the vacuum reservoir and the vacuum port when the first operating condition is not occurring.

In any of the aspects described herein or combinations of the aspects, the first operating condition may include a condition when a vacuum pressure in the vacuum reservoir is less than a vacuum pressure in the intake manifold.

In any of the aspects described herein or combinations of the aspects, the engine system is a braking system.

In any of the aspects described herein or combinations of the aspects, the method may further include flowing intake air through the vacuum aspirator from an air intake port in the vacuum aspirator to a manifold port in the vacuum aspirator, the manifold port coupled to a manifold vacuum passage extending through the housing of the intake manifold.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will further be appreciated by those skilled in the art that although the invention has been described by way of example with reference to several embodiments it is not limited to the disclosed embodiments and that alternative embodiments could be constructed without departing from the scope of the invention as defined in the appended claims.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described methods. The subject matter of the present disclosure includes all novel and non-obvious combinations and sub-combinations of the various systems and configurations, and other features, functions, and/or properties disclosed herein.

The invention claimed is:

1. A vacuum system comprising:

a vacuum aspirator directly coupled to a housing of an intake manifold, where the vacuum aspirator includes an air intake port, a vacuum port, a manifold port, and a housing, where the housing includes a surface surrounding the manifold port and is in face-sharing contact with a section of the housing of the intake manifold adjacent to a manifold vacuum passage traversing through a wall of the housing of the intake manifold; and a vacuum reservoir passage traversing the wall of the housing of the intake manifold;

where the wall defines a boundary of an interior section of the intake manifold;

where the manifold vacuum passage is coupled to the manifold port and the vacuum reservoir passage is coupled to the vacuum port; and where the manifold vacuum passage includes an inlet positioned in the wall of the intake manifold housing and directly opens into the manifold port.

2. The vacuum system of claim 1, further comprising a check valve positioned in the vacuum port.

3. The vacuum system of claim 2, where the check valve opens when a vacuum pressure in the vacuum port is greater than a vacuum pressure in a vacuum reservoir, the vacuum reservoir in fluidic communication with the vacuum reservoir passage.

4. The vacuum system of claim 1, where the air intake port is coupled to an intake conduit upstream of a throttle via an external air inlet conduit.

5. The vacuum system of claim 1, further comprising a vacuum reservoir in fluidic communication with the vacuum reservoir passage.

6. The vacuum system of claim 5, where the vacuum reservoir is positioned between an intake runner and the intake manifold and where the intake runner is in fluidic communication with the intake manifold.

7. The vacuum system of claim 6, where the vacuum reservoir is positioned vertically above the intake manifold and adjacent to a section of the intake runner.

8. The vacuum system of claim 1, where the vacuum reservoir passage and the manifold vacuum passage vertically extend through the housing of the intake manifold.

9. The vacuum system of claim 1, where the intake manifold and the vacuum reservoir share a common boundary wall.

10. The vacuum system of claim 1, further comprising a compressor upstream of the intake manifold.

11. A vacuum system comprising:

a vacuum aspirator directly coupled to a housing of an intake manifold, the vacuum aspirator including an air intake port, a vacuum port, a manifold port, and a housing, where the housing includes a surface surrounding the manifold port and is in face-sharing contact with a section of the housing of the intake manifold adjacent to a manifold vacuum passage traversing through a wall of the housing of the intake manifold;

a vacuum reservoir passage traversing the wall of the housing of the intake manifold; and a vacuum reservoir in fluidic communication with the vacuum reservoir passage;

where the manifold vacuum passage extends between the manifold port and an interior chamber of the intake manifold and the vacuum reservoir passage extending between the vacuum port and the vacuum reservoir; and where the manifold vacuum passage includes an inlet positioned in the wall of the intake manifold housing and directly opens into the manifold port.

12. The vacuum system of claim 11, where the vacuum reservoir is positioned between an intake runner and the intake manifold and where the intake runner is in fluidic communication with the intake manifold.

13. The vacuum system of claim 11, where the vacuum reservoir is positioned adjacent to an intake runner and vertically above the intake manifold.

14. The vacuum system of claim 11, where the vacuum reservoir is positioned laterally between two sections of an intake runner.

15. The vacuum system of claim 11, where the vacuum reservoir passage and the manifold vacuum passage vertically extend through the housing of the intake manifold.

16. A method for operating a vacuum system, comprising:

during a first operating condition, increasing a vacuum pressure in a vacuum reservoir by drawing air from the vacuum reservoir to a vacuum aspirator through a vacuum conduit extending through a housing of an intake manifold, the vacuum conduit coupled to a vacuum port in the vacuum reservoir, where the vacuum aspirator includes a housing, where the housing includes a surface surrounding the manifold port and is in face-sharing contact with a section of the housing of the intake manifold adjacent to a manifold vacuum passage traversing through a wall of the housing of the intake manifold; and during a second operating condition, providing a vacuum to an engine system from the vacuum reservoir;

where the vacuum conduit includes an inlet positioned in the wall of the intake manifold housing and directly opens into the vacuum port.

17. The method of claim 16, further comprising inhibiting airflow between the vacuum reservoir and the vacuum port when the first operating condition is not occurring.

18. The method of claim 17, where the first operating condition includes a condition when the vacuum pressure in the vacuum reservoir is less than a vacuum pressure in the intake manifold.

19. The method of claim 16, where the engine system is a braking system.

20. The method of claim 16, further comprising flowing intake air through the vacuum aspirator from an air intake port in the vacuum aspirator to a manifold port in the vacuum aspirator and where the manifold port is coupled to a manifold vacuum passage extending through the housing of the intake manifold.

* * * * *